US007096612B2

(12) United States Patent
Lesaga

(10) Patent No.: US 7,096,612 B2
(45) Date of Patent: Aug. 29, 2006

(54) DOMESTIC STEAM IRONS HAVING A VAPORIZATION CHAMBER AND FITTED WITH INDEPENDENT HEAT ELEMENT

(75) Inventor: Javier Alday Lesaga, Vitoria-Alava (ES)

(73) Assignee: Celaya, Emparanza Y Galdos, Internacional, S.A., Victoria-Alava (ES)

( * ) Notice: Subject to any disclaimer, the term of this patent is extended or adjusted under 35 U.S.C. 154(b) by 0 days.

(21) Appl. No.: 11/046,583

(22) Filed: Jan. 28, 2005

(65) Prior Publication Data

US 2005/0183296 A1 Aug. 25, 2005

(30) Foreign Application Priority Data

Jan. 30, 2004 (ES) ..... 200400197
Dec. 1, 2004 (ES) ..... 200402896

(51) Int. Cl.
*D06F 75/18* (2006.01)

(52) U.S. Cl. ..... 38/77.83

(58) Field of Classification Search ..... 38/74, 38/77.8, 77.82, 77.7, 77.83, 93; 219/251, 219/252, 253, 254, 255

See application file for complete search history.

(56) References Cited

U.S. PATENT DOCUMENTS

| | | | | |
|---|---|---|---|---|
| 1,840,652 | A * | 1/1932 | Bell | 219/252 |
| 2,345,413 | A * | 3/1944 | Morton | 38/77.7 |
| 2,846,793 | A * | 8/1958 | Studer | 38/77.9 |
| 2,970,394 | A * | 2/1961 | Brumbaugh | 38/77.9 |
| 3,110,975 | A * | 11/1963 | Kircher | 38/77.7 |
| 4,536,641 | A * | 8/1985 | Chan | 219/253 |
| 5,279,054 | A * | 1/1994 | Chasen | 38/77.7 |
| 5,979,089 | A * | 11/1999 | Bouleau et al. | 38/77.83 |
| 6,216,369 | B1 * | 4/2001 | Wolf et al. | 38/93 |
| 6,263,596 | B1 * | 7/2001 | Pedron et al. | 38/77.7 |

* cited by examiner

*Primary Examiner*—Ismael Izaguirre
(74) *Attorney, Agent, or Firm*—Knobbe, Martens, Olson & Bear LLP

(57) ABSTRACT

Domestic steam iron including an ironing element or plate, a vaporization element or vaporizer which is fed with water coming from a reservoir incorporated within the iron, and comprising a vaporization chamber where the steam is generated which passes through the plate via a front opening of the vaporizer, to emerge into the exterior through holes formed in the plate, and also comprising heat element for each of the plate and vaporizer assigned to the plate and the vaporizer, and thermostatic temperature regulators for each of the plate and vaporizer, and thermal fuses of each of the plate and vaporizer, associated with the plate and the vaporizer, wherein the vaporization chamber is provided with a rear outlet communicating with the front opening of the vaporizer by way of a pair of deep channels that are integrated in the vaporizer and extend co-laterally to the vaporization chamber itself.

24 Claims, 5 Drawing Sheets

DOMESTIC STEAM IRONS HAVING A VAPORIZATION CHAMBER AND FITTED WITH INDEPENDENT HEAT ELEMENT

BACKGROUND OF THE INVENTION

The present invention relates to the plate of a domestic steam iron of standard construction that comprises an ironing element or plate that, by means of a laminated stainless steel covering or other appropriate material, is the component that comes into contact with the garment that is to be ironed; a vaporiser or steam-generating component that is provided with water from a container that is situated in the iron and comprises a vaporisation chamber where the steam is generated and from which the steam passes through a front opening on the vaporiser to the plate and then passes out to the exterior via holes provided on the plate; the heat element components on the plate and the vaporiser, as their names imply, being allocated to the plate and the vaporiser; and the thermostatically controlled regulators of the temperature of the plate and the vaporiser; and the thermal fuses of the plate and the vaporiser being respectively associated with the plate and the vaporiser.

The present subsidiary patent relates to the plate of a domestic steam iron of standard construction that comprises an ironing element or plate that, by means of a laminated stainless steel covering or other appropriate material, is the component that comes into contact with the garment that is to be ironed; a vaporiser or steam-generating component that is provided with water from a container that is situated in the iron and comprises a vaporisation chamber where the steam is generated and from which the steam passes through a front opening on the vaporiser to the plate and then passes out to the exterior via holes provided on the plate; the heat element components on the plate and the vaporiser, as their names imply, being allocated to the plate and the vaporiser; and the thermostatically controlled regulators of the temperature of the plate and the vaporiser; and the thermal fuses of the plate and the vaporiser being respectively associated with the plate and the vaporiser.

In first generation domestic steam irons, the required heating necessary for vaporising the water was generated by the same heating element responsible for heating the plate.

Domestic steam irons of this kind operate at temperatures within the range of 100° C. to 200° C. Within this temperature range and close to 100° C. the steam is not saturated and is designated as 'wet steam' since it is close to the limit between the liquid state and steam state, but still comprises a considerable proportion of the liquid phase, and in which a portion of the steam phase passes readily into the liquid phase as soon as there is a relatively small drop in the temperature. Conversely, as the temperature rises a more highly saturated water vapour is obtained which is designated as 'dry steam' (approximately, above 120° C.), and the liquid phase becomes increasingly less significant, and in such a manner that at the higher levels of the temperature range indicated, the steam phase becomes increasingly more stable, and, in order to revert to the liquid phase, a significant lowering of the temperature is necessary.

Because of what has been indicated above, when it comes to the actual practice of ironing, there are no real problems when working at a temperature within the higher levels of the said range, where a good supply of 'dry steam' is provided, and the high temperature of the iron itself is suitable for the fabric being ironed, and, as a result, the garment does not suffer any damage.

However, when fabrics and delicate garments have to be ironed, it is necessary for the temperature of the ironing element to be at the lower limit of the said working range. As this ironing element and the vaporiser compartment are heated by the one and only heating element, the result is that the steam produced that is available for the ironing procedure is 'wet steam'. A consequence of this is that, while ironing, a dripping is produced that wets the garment and becomes a nuisance and diminishes the quality of the ironing. This phenomenon is aggravated by the cooling of the ironing implement around its steam outlet holes, which cooling is very significant since it comes very close to the temperature of the steam being expelled and of the ironing element.

At present, a new generation of domestic steam irons is known in which, independently of the assembly comprising the ironing element, the heating element and the thermostatic element which conventional domestic steam irons have, the plate itself incorporates an autonomous vaporiser unit which is integrated with a vaporisation chamber that has a water supply channel connected to the water reservoir of the domestic iron, and the vaporisation chamber of which is fitted with its own heating element which has its own thermostat for regulating the temperature in this vaporisation chamber; the autonomous vaporiser unit has a steam outlet connected to a complementary inlet for steam into the ironing element, and for providing the correct pathway for steam to pass towards the outlet holes. In this way, the production of steam becomes thermally independent of the ironing element, and the iron is provided with dry steam at any temperature, improving the dripping effect and allowing the ironing element to operate at a lower temperature (but still above 100° C.) and improving the quality of the ironing.

However, in these domestic steam irons, there remain certain problems requiring correction or improvement.

One of these problems is the tendency to produce an accumulation of lime-scale which progressively obstructs the passage of the steam to the expellation holes in the plate, due to the lack of a duct available for the passage of steam and/or the lack or insufficiency of filtering means for the lime residues carried by the steam.

Another problem lies in the manner of resolving the passage of the steam between the vaporiser and the plate, being independent units connected to one another. In this respect, the use of a brass cap is known which is simultaneously attached by its ends to such vaporiser and the plate, incorporating at each point of attachment an annular, peripheral, silicone gasket. It is supposed that with this assembly concept the brass cap as well as the silicone gaskets work disadvantageously and in an uneven manner.

Another problem consists in the fact that temperature control of the plate and the vaporiser rely on the presence of thermostats which are insufficiently sensitive and have a slow response time, which results in the continuation of dripping, albeit less, and in the reliability of ironing remaining unsatisfactory.

Another frequent problem is that the steam outlet holes in the plate are distributed over the whole length of the plate, even though they are only close to the side edges of the plate. This means that during ironing with steam the garment retains humidity after the ironing stroke, which is undesirable when ironing delicates.

The present invention relates to a domestic steam iron that corresponds to the general form described above in that it comprises a vaporisation chamber and a plate which, as illustrated in FIG. 1, are proportional in a manner such that, on the one hand, the width of the first is around half that of the second, and on the other hand, the sides of the vaporisation chamber are approximately in a straight line and converge with respect to one other in such a manner that they progressively diverge away from the edge of the plate. Another embodiment of the present invention provides a different relative geometry between the vaporisation chamber and the plate.

Another embodiment of the present invention provides a passage for the steam from the said vaporisation chamber to the plate via a horizontal pipe.

Another embodiment of the present invention relates to a distinctive internal structure of the vaporisation chamber.

SUMMARY OF THE INVENTION

In view of the prior art, an embodiment of the present invention provides a vaporisation chamber that has a rear outlet that communicates with a front opening of the vaporiser by way of a pair of deep channels that are integrated into the vaporiser and that extend co-laterally to the vaporisation chamber itself. This solution assumes a considerable increase in size of the section of the passage for circulation of steam, due both to the greater depth of the channels as well as to the provision of two channels instead of one. At the same time, the possession of two channels provides an alternative that ensures circulation of steam towards the plate in the possible event that one of the channels becomes obstructed or considerably constricted.

But in order to guarantee even better circulation of steam without obstructions between the vaporiser and the plate, another feature of the invention consists in the rear outlet of the vaporisation chamber being closed by a mesh that is immovable and has a passage that is suitably smaller than the sections of passage at the said front opening and of the said channels.

Since the outlet from the vaporisation chamber is at the rear and the steam must flow along the length of the vaporiser to reach its front opening, this reduces the risk of obstruction and allows for a homogeneous temperature over the whole of the vaporiser, and thus ensures that only steam leaves this chamber and not steam plus water.

Another embodiment of the invention provides a front opening of the vaporiser comprising a tube that is produced as a single unit in the vaporiser itself and that can be slotted into a corresponding orifice in the plate, which tube incorporates an external, immovable watertight gasket that acts between the said vaporiser and plate, and that is made of a material that is suitable for working under compression and at high temperatures. With this solution, only a single gasket is provided which does not function as a separator but rather as a compression piece. This provision accordingly utilizes a gasket made of a fluoro-elastomeric material which works better under compression than silicone and, in addition, is very tolerant of high temperatures. Furthermore, the coupling of the vaporiser to the plate is direct (does not require the use of any additional connection pieces, as does the brass cap) and resists better the stresses imposed by the ironing action and by temperature changes.

Another feature of the invention provides that the thermostatic temperature-regulating means of the plate and vaporiser consist of primary and secondary thermal probes. It is anticipated that the thermal probes to be used are NTC (sensors also called NTC-Negative Temperature Coefficient thermistors) which are highly sensitive and have a rapid response time when compared with traditional thermostats that have been used until now. These properties of the thermal probes provide much greater precision and efficiency that will be reflected in the quality of the ironing when compared with other known domestic steam irons. In this connection, it should be said that resorting to inserting a third backup thermostat connected in series to the vaporiser is known, because, given the delay in response of the principal thermostat of the vaporiser, it becomes necessary to short-circuit this thermostat every time the micro-pump is activated, i.e. water gets in and the vaporiser's element operates immediately, otherwise not all the water is vaporised but, instead, a mixture of steam and water is obtained, whereas an NTC probe is advantageously used as a substitute for these two conventional thermostats (the normal and the subsidiary backup). On the other hand, the use of NTC probes makes the technology of the iron more electronic, and more coherent and compatible with the use of control chips containing computer programmes and display screens in which the relevant information is displayed regarding the condition of the iron and the ironing mode selected.

Another embodiment of the present invention is that the said holes in the plate are fewer in number and are concentrated in the front section of the plate in the shape of an arrow head, and that they have the special feature that they open into certain grooves that extend to the rear section of the plate in the form of channelling grooves. With this solution, humidification of the garment is achieved by the front part of the plate, and drying is achieved as it passes down the rest of the plate so that ironing of superior quality is obtained.

In the light of the above an embodiment of the present invention is for the existing relationship between the widths of the vaporisation chamber and the plate to be of the order of three quarters, and because the geometry of the said vaporisation chamber is such that its sides are parallel to those of the said plate. This configuration proposed here assumes a considerable and significant increase in the capacity of the vaporisation chamber. At the same time, the greater absolute width of the vaporisation chamber allows the mesh that closes the rear of the vaporisation chamber to be larger. Finally, the lime accumulation capacity is considerably increased so that the useful life of the product is prolonged.

Another embodiment is that the said front opening of the vaporiser comprises a vertical tube whose other open end penetrates an expansion chamber provided in the plate, and which is closed underneath by a sheet that is preferably made of stainless steel and which covers the lower surface of the plate as the element in contact with the garment being ironed. This solution has been demonstrated to be more convenient since the plate is less prone to be subject to possible blockage by lime accumulation.

A possible variant to the above consists in that the said front opening of the vaporiser has a vertical duct that is sealed at its other end, and has lateral openings that communicate with an expansion chamber situated in the plate and is sealed underneath by a sheet which is preferably made of stainless steel, and covers the lower surface of the plate as the element of contact with the garment being ironed.

Another embodiment is that the interior of the vaporisation chamber contains at least one partition that extends over its entire height, and is attached to one of the side walls thereof but without reaching the opposite side wall. As will be shown below, a preferred embodiment contains two such partitions. This solution attempts to prevent the passage of the generated steam towards the plate from being too direct, so that it ensures that the steam emerging will not drag with it still liquid water which is present with the steam at a specific stage of the vaporisation procedure, until the pre-set temperature, at which all the water in the vaporisation chamber has been vaporised, has been reached.

BRIEF DESCRIPTIONS OF THE DRAWINGS

In order to understand better the nature of the present invention, the following drawings illustrate a preferred industrial embodiment, which is purely by way of an illustrative example, but which is not limited thereto.

Figure 1:
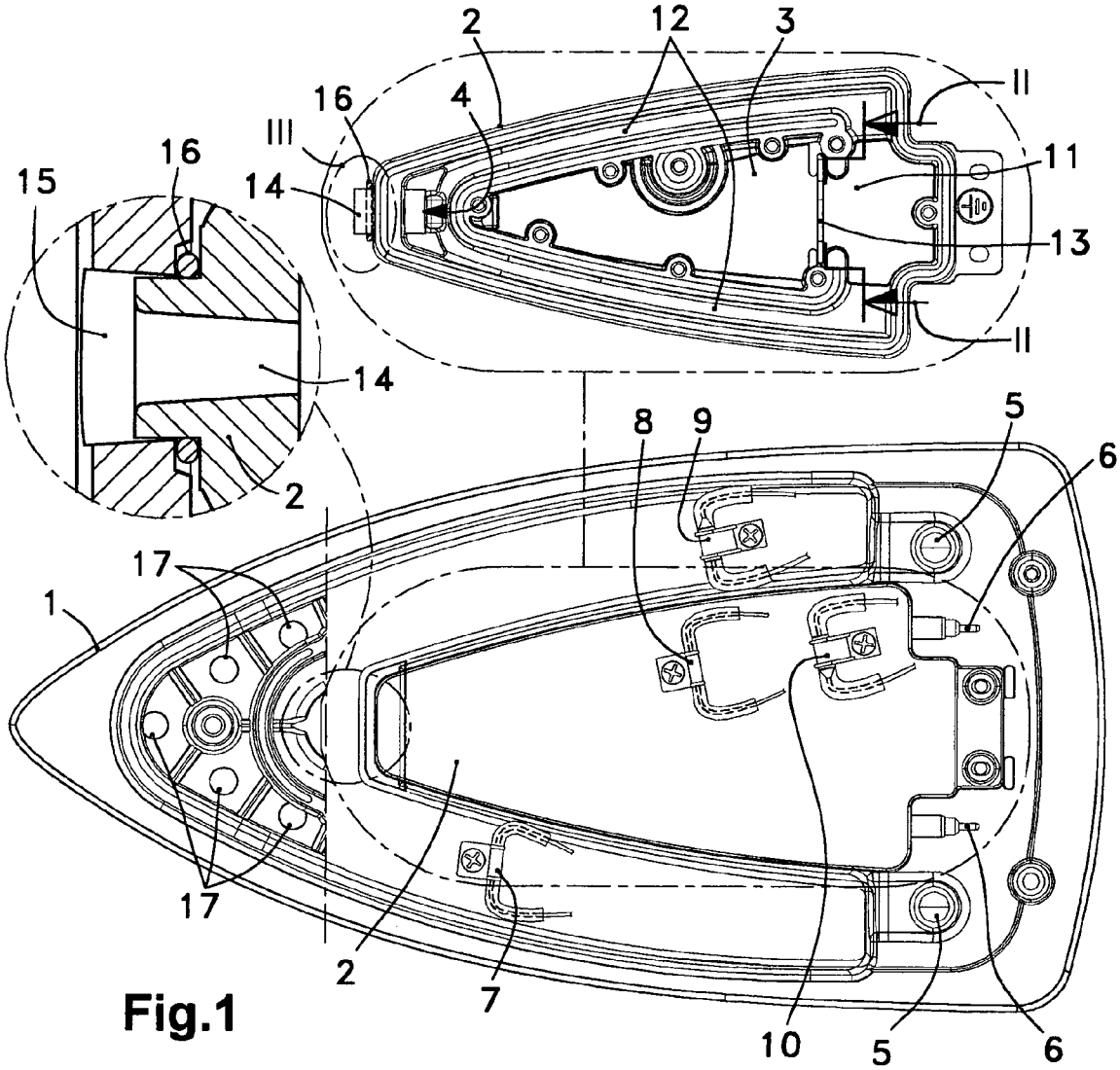
FIG. 1 shows a view from above of the assembly of plate (1) and vaporiser (2), where the plate (1) has its upper section deleted in the front section and where there is incorporated a detail referring exclusively to the vaporiser (2) whose cover has been removed and a wider section that illustrates how the tube (14) of the vaporiser (2) is inserted into the orifice (15) in the plate.

The following references are used in these drawings:

1. Plate
1*a*. Steam expansion chamber in the plate (1)
2. Vaporiser
3. Vaporisation chamber in the vaporiser (2)
3*a*. Vertical tube in the vaporisation chamber (3)
3*b*. Vertical conduit of the vaporisation chamber (3)
3*c*. Lateral ports in the vertical conduit (3*b*)
3*d*. Partition wall in the vaporisation chamber (3)
4. Front opening of the vaporiser (2)
5. First heating element, of the plate
6. Second heating element, of the vaporiser
7. First thermal sensor, of the plate
8. Second thermal sensor, of the vaporiser
9. First thermal fuse, of the plate
10. Second thermal fuse, of the vaporiser
11. Rear outlet of the vaporisation chamber (3)
12. Channels of the vaporiser (2)
13. Mesh in the rear outlet (11)
14. Vaporiser tube
15. Orifice of the plate
16. Gasket
17. Holes in the plate (1)
18. Channels in the plate (1)
19. Sheet, preferably made of stainless steel

DESCRIPTION OF A PREFERRED EMBODIMENT

With regard to the drawings and references listed above, the drawings indicate a preferred embodiment of the invention relating to a domestic steam iron which, in its general structure, comprises an ironing element or plate (1) which comes into contact with the garment that is to be ironed, a vaporising component or vaporiser (2) which is provided with water originating from a reservoir incorporated within the iron (by means of a micro-pump, not illustrated) and comprises a vaporisation chamber (3) where the steam is generated, which steam is passed through a front opening (4) of the vaporiser (2) to the plate (1) to emerge into the exterior through holes (17) provided in the plate, and also comprising heat element, of each of the plate (5) and the vaporiser (6), assigned to the plate (1) and the vaporiser (2), thermostatic regulators for each of the temperature of the plate (1) and the vaporiser (2), and thermal fuses for each of the plate (9) and vaporiser (10) associated with the plate (1) and the vaporiser (2).

This general construction is illustrated in FIG. 1, where an object of the invention (see the details shown in this FIG. 1.) is represented, in which the said vaporisation chamber (3) has a rear outlet (11) that communicates with the front opening (4) of the vaporiser (2) by way of a pair of deep channels (12) that are integrated into the vaporiser (2) and extend along the sides to the vaporisation chamber (3) itself. In this manner, the steam generated in the vaporisation chamber (3) passes from there to the rear outlet (11) and proceeds via both channels (12) co-lateral therewith to end by reaching the front opening (4) and arrive at the plate (1) to be expelled through its holes (17). This solution provides better conditions than those currently known for circulating steam, resulting in reduced possibility of blockages due to accumulation of lime and, finally, a better guarantee of adequate and constant supply of steam for a more efficient ironing process.

Figure 2:
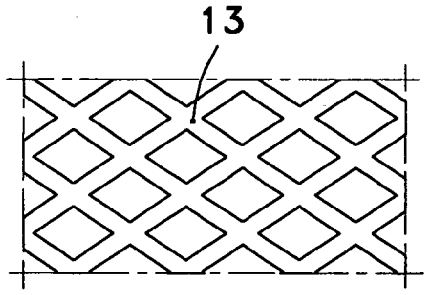
FIG. 2 is an enlargement of section II—II in FIG. 1 and referring to the mesh (13).
Figure 4:
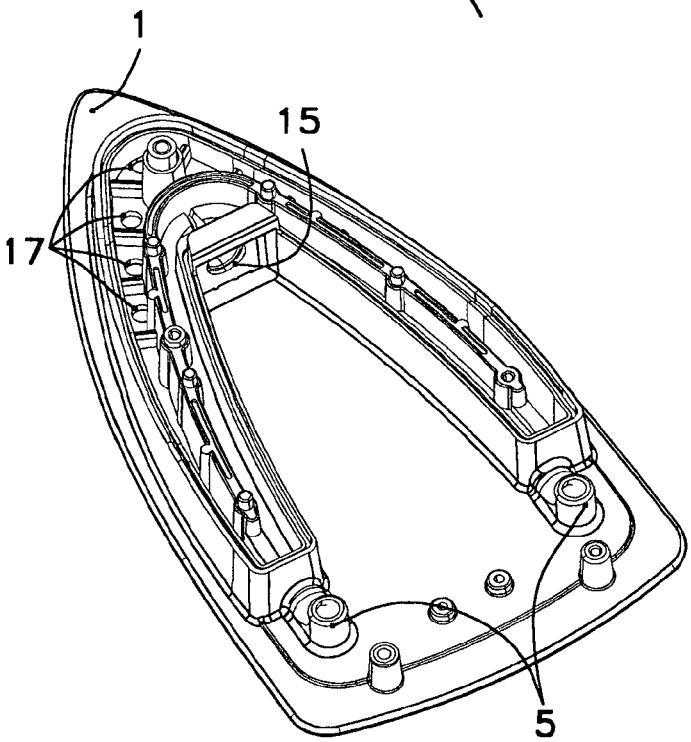
FIG. 4 is a perspective view from above of the plate (1) in FIG. 1.

In order better to ensure an absence of lime-scale accumulated in the channels (12), and hence also in the front opening (4), another object of the invention consists (FIGS. 1 and 2) in the said rear outlet (11) of the vaporisation chamber (3) being closed by a fixed mesh (13) and which contains a passage conveniently smaller than the channel sections at the front opening (4) and the said channels (12).

Figure 3:
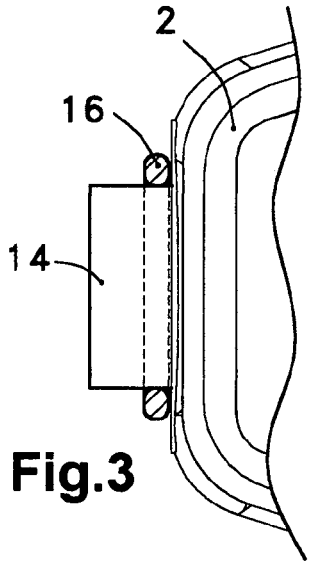
FIG. 3 is an enlargement of detail III indicated in FIG. 1.

According to another embodiment of the invention (FIGS. 1 and 3) the said front opening of the vaporiser (2) comprises a tube (14) formed entirely in the vaporiser (2) itself and which can be inserted into a corresponding orifice (15) of the plate (1), of which the tube (14) incorporates an external fixed watertight gasket (16) that acts between the said vaporiser (2) and plate (1), and that is made of a material suitable for the compression procedure as well as for high temperatures. As has been explained previously, this solution envisages the use of a gasket of fluoro-elastomeric material which advantageously is a substitute for another known solution which utilizes a separate brass cap that is inserted simultaneously in the vaporiser (2) and the plate (1), together with the alternating placement of each of the silicone gaskets that behave well at high temperatures but do not work well under compression.

Another embodiment of the invention that is also illustrated in FIG. 1, consists in that the said thermostatic means for regulating the temperature of the plate (1) and the vaporiser (2) comprise thermal sensors, of the plate (7) and the vaporiser (8). As explained above, these thermal sensors (7, 8) provide operation with great precision and speed that avoids the use of a second backup thermostat of conventional type for the vaporiser (2) and provides for the implementation of computer-programmable micro-processors (chips), and of LCD display screens, that show the working stages of the iron at any particular moment, and provides for more efficient and reliable ironing with the greatest accuracy in determining the correct temperature for each type of garment, and for greater speed in producing changes in the ironing temperature.

Figure 5:
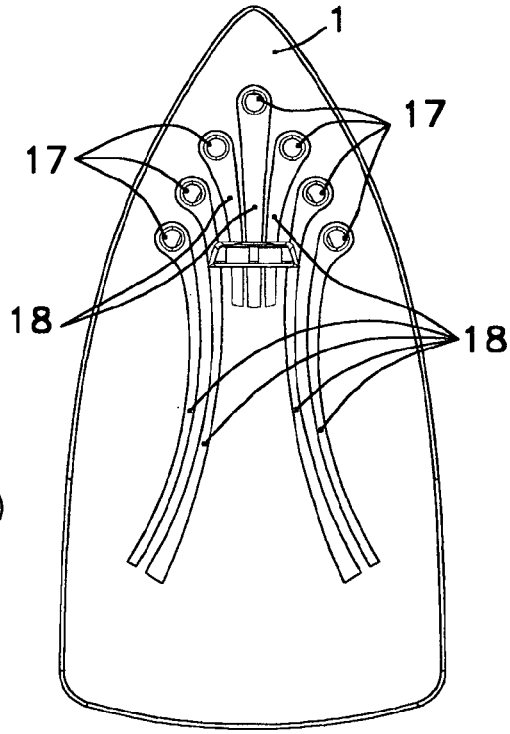
FIG. 5 is a front view of the lower face of the plate (1) according to the invention.
Figure 6:
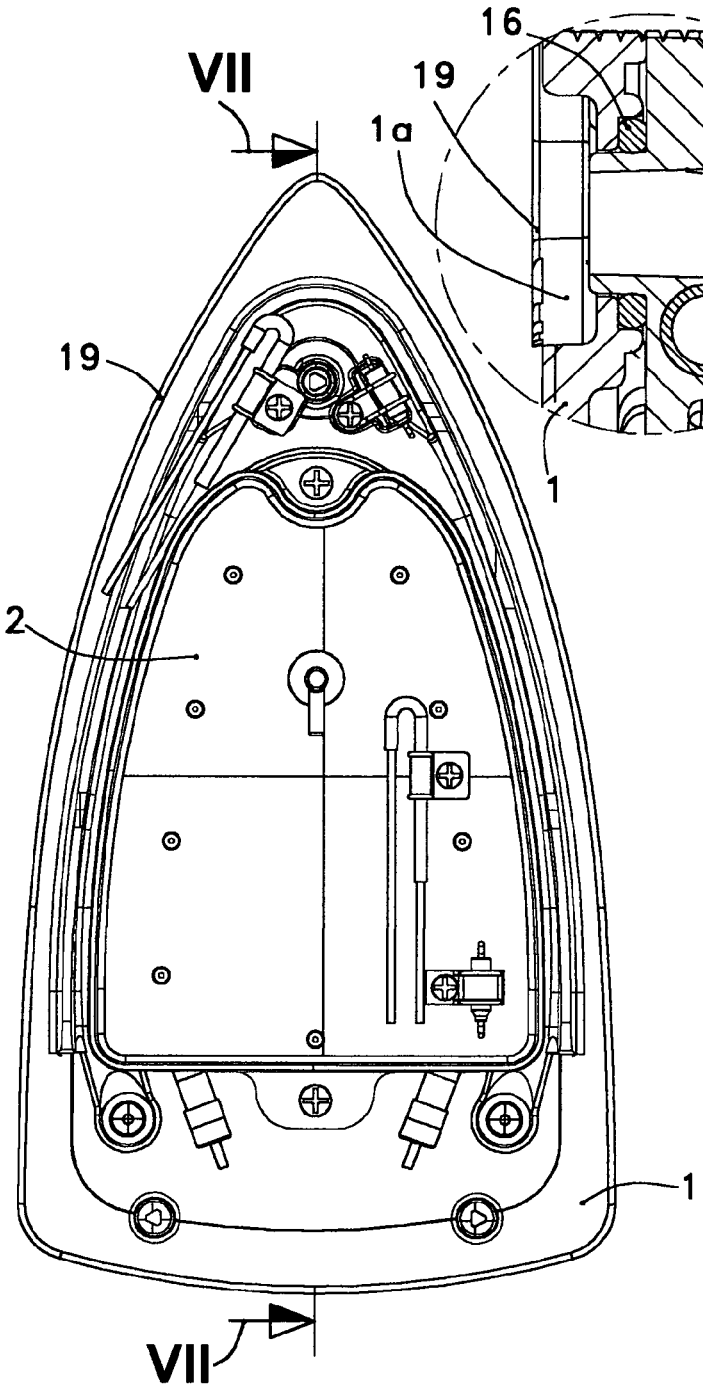
FIG. 6 is a view from above of the assembly comprising the plate (1) and the vaporiser (2), with its vaporising chamber (3), all being in accordance with the present invention.

Another embodiment of the invention is that the said holes (17) in the plate (1) are provided in a reduced number, concentrated at the front section of the plate (1) in arrowhead formation, and having the special feature of being open within grooves that extend to the rear section of the plate (1) each being in the form of channels (18). In particular, the preferred embodiment shown in FIG. 5 demonstrates that the said holes (17) and channels (18) are seven in number, the three central channels (18) extend to approximately the first third of the length of the plate (1), and the remaining four channels (18) extending to approximately a quarter of the length of the plate (1) measured from the extreme rear end of the plate.

This solution enables the garment to receive the required steam for the ironing procedure at the start of the motion of the iron, and that during the rest of this movement there will be a progressively increased degree of drying to total dryness, which results in an ironing procedure of professional quality.

Figure 8:
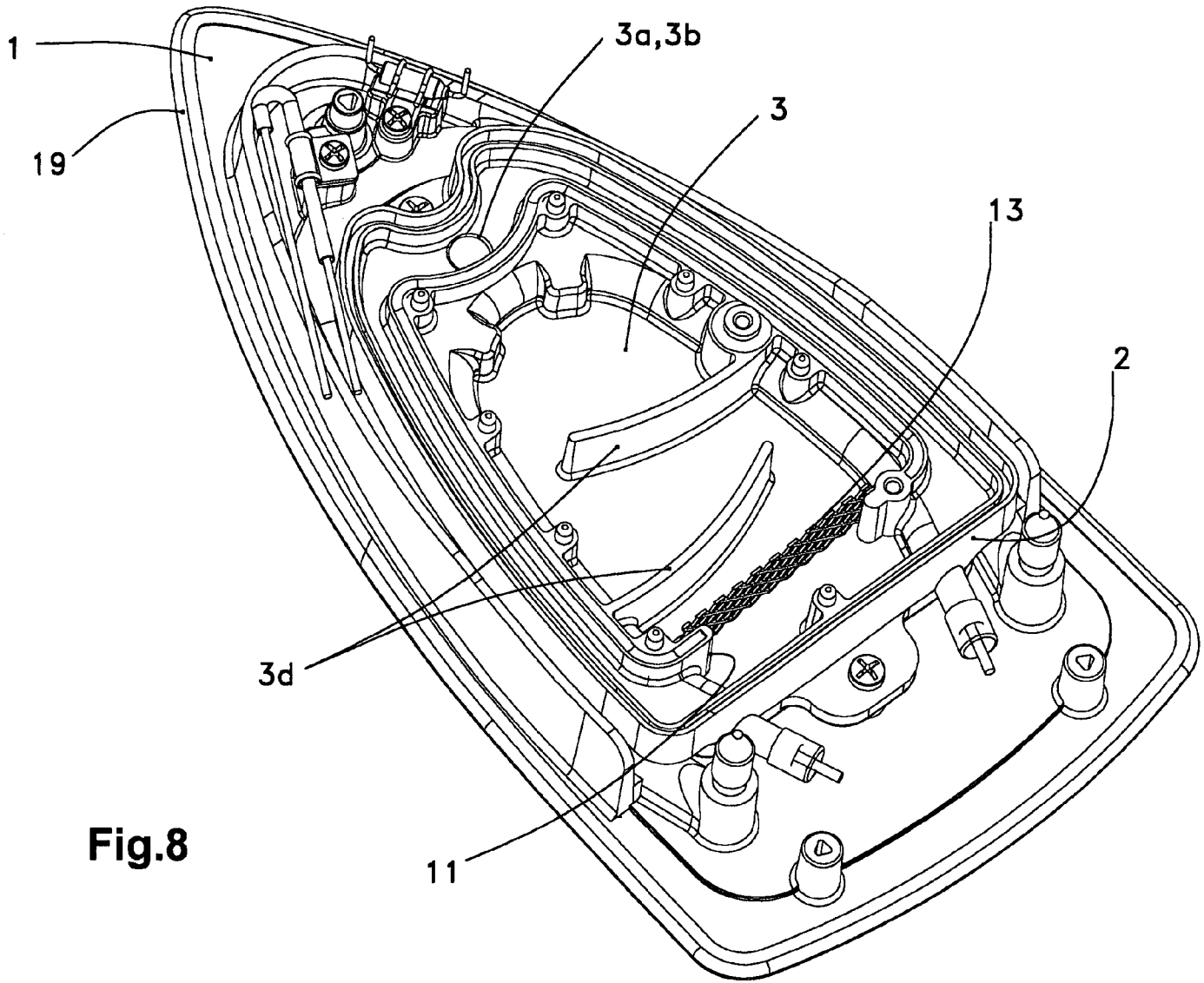
FIG. 8 is a perspective view showing the assembly of FIG. 6 in which the vaporising chamber (3) is without its cover to facilitate visual access to its interior.

With regard to the drawings and references listed above, a preferred embodiment is illustrated in the attached drawings. One of the objects of these improvements (FIG. 1) lies in that the existing ratio between the widths of the vaporisation chamber (3) and the plate (1) is in the order of three quarters, because the geometry of the said vaporisation chamber (3) is such that its sides are parallel to those of the said plate (1). In accordance with what has been outlined previously, it is now possible to confirm visually that there is a considerable increase in the volume of the vaporisation chamber (3) which, as can be seen from FIG. 8, benefits from the mesh (13) being substantially larger than previously and being able to accumulate larger quantities of lime from the water and, consequently, to facilitate a longer, useful life of the product, because it is lime deposits that cripple this type of iron.

Figure 7:
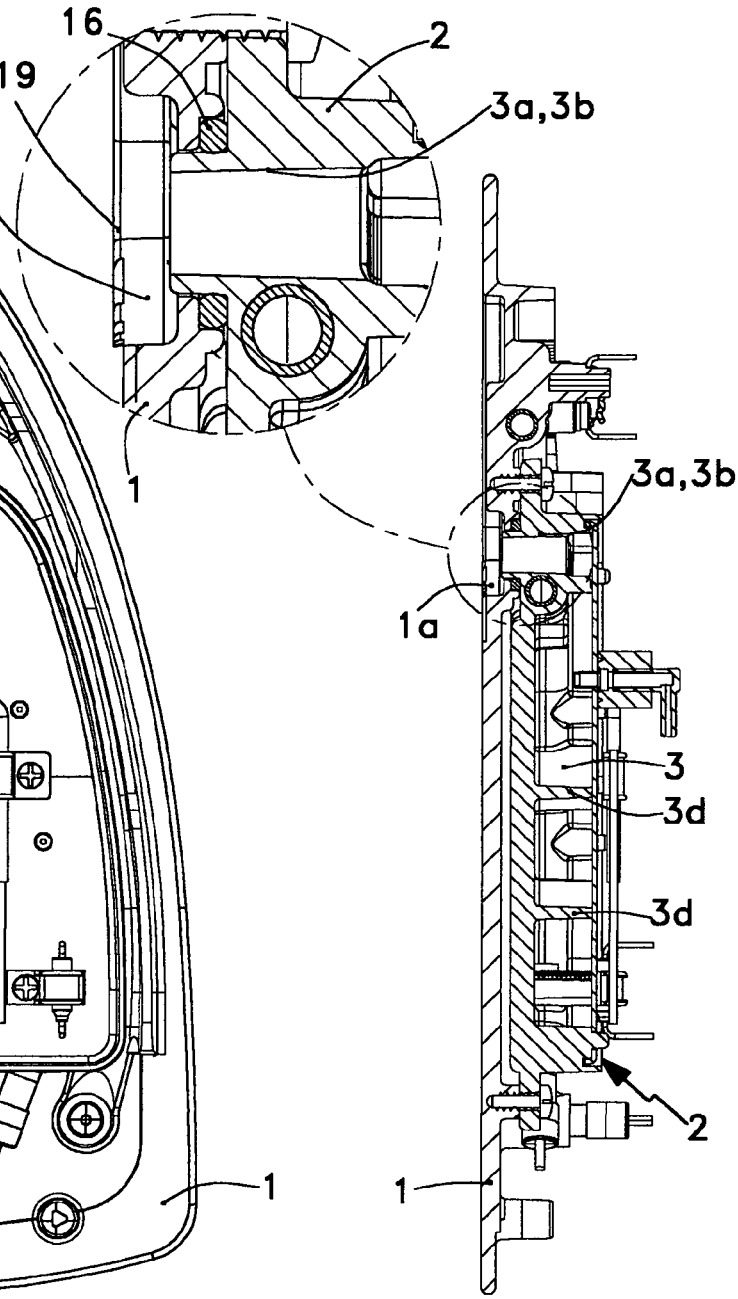
FIG. 7 is section VII—VII as shown in FIG. 6, and in which a larger detail is shown in respect of the vertical conduit (3*b*) and the expansion chamber (1*a*).
Figure 9:
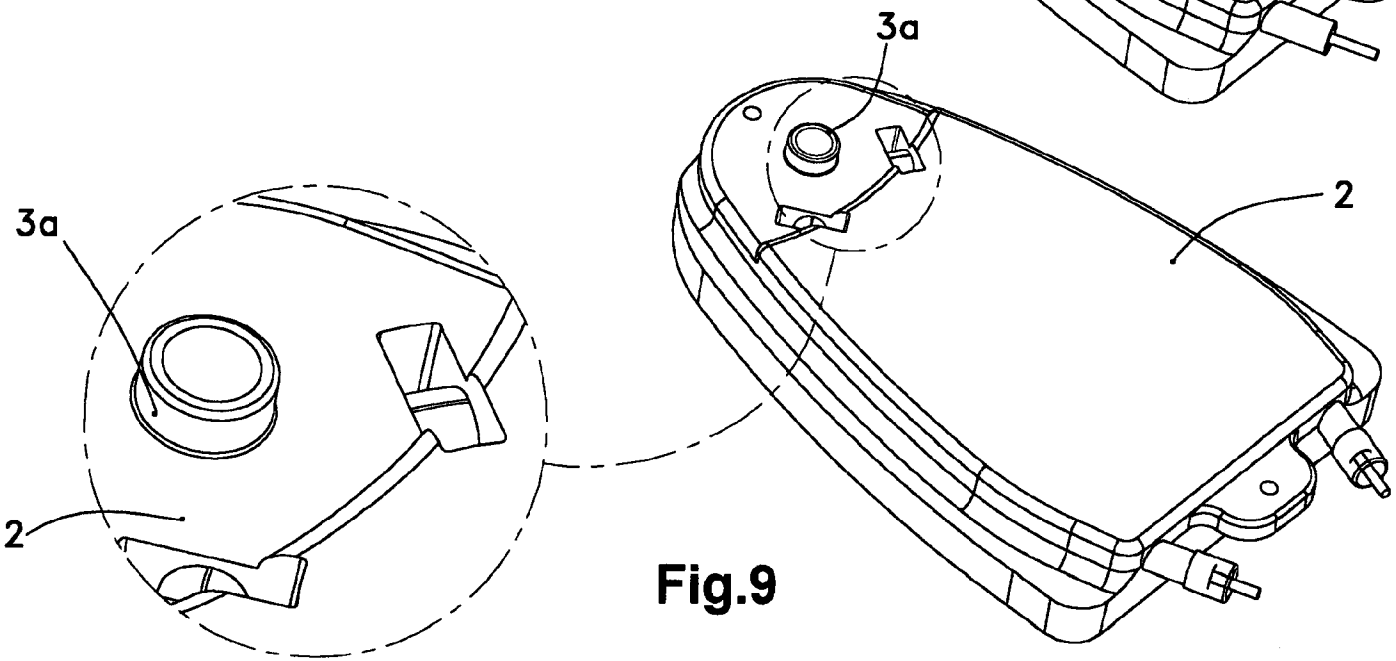
FIG. 9 is a perspective view of the vaporisation chamber (3) from its lower surface and includes a larger detail showing a variation to the construction of the vertical conduit (3*b*).

Another embodiment of this invention is that the said front opening (4) of the vaporiser (2) comprises a vertical tube (3*a*) the other end of which opens into an expansion chamber (1*a*) formed in the plate and for it to be closed below by a sheet (19) which is preferably made of stainless steel, and which covers the lower surface of the plate (1) as the element of contact with the garment to be ironed. This procedure is clearly illustrated in FIG. 7, especially in the enlarged details, where the situation of the gasket (16) can also readily be identified, and its position guarantees watertightness between the vaporisation chamber (3) and the plate (1), against the circulating steam which, through the said expansion chamber (1*a*), ends up emerging via the holes (17) to the exterior of the plate (1) and its corresponding ones in the sheet (19). This variation to the vertical tube (3*a*) is also illustrated in FIG. 9.

Figure 10:
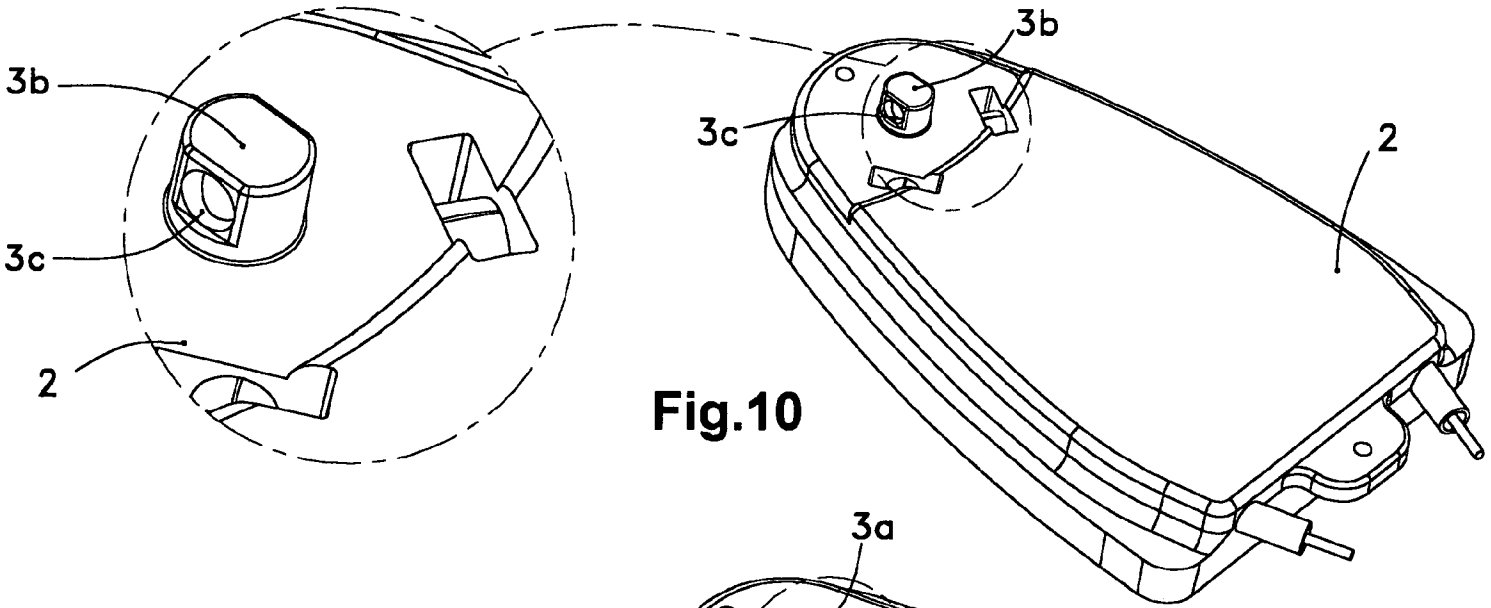
FIG. 10 is a similar representation to FIG. 9, but refers to another variant to the construction of the vertical conduit (3*b*).

By way of a variant to this, the invention also proposes a solution whereby the said front opening (4) of the vaporiser (2) is a vertical conduit (3*b*) which is closed at its other end, and is provided with lateral ports (3*c*) which communicate with an expansion chamber (1*a*) formed in the plate and which is closed below by a sheet (19) which is, preferably, made of stainless steel, and which covers the lower surface of the plate (1) as the element of contact with the garment to be ironed. This solution is clearly illustrated in FIG. 10.

Another feature that is an embodiment the present invention is that the interior of the vaporisation chamber (3) contains at least one partition wall (3*d*) which occupies the whole available height, and is attached to one of the side walls of the chamber but without extending to the opposite side wall. This solution is clearly illustrated in FIG. 8, where a preferred embodiment can be seen in which two of the said partition walls (3*d*) are provided, arranged in opposing directions and generating a wave pattern between the front part and the rear outlet (11) of the vaporisation chamber (3).

The invention claimed is:

1. A domestic steam iron, comprising:

a soleplate having a plurality of steam outlet holes;

a steam generator having a front portion and a rear portion, the steam generator comprising:

a vaporization chamber for generating steam, the vaporization chamber comprising a front portion and a rear portion, wherein the rear portion of the vaporization chamber comprises an outlet that is covered by mesh;

an opening in the front portion of the steam generator, through which steam generated in the vaporization chamber passes to the steam outlet holes in the soleplate; and a pair of channels that provide a passageway for steam generated in the vaporization chamber and that extend, one on either side of the vaporization chamber, from the outlet of the vaporization chamber to the opening in the front portion of the steam generator;

a first heating element, for heating the soleplate, the first heating element comprising a first thermal sensor; and a second heating element, for heating the steam generator, the second heating element comprising a second thermal sensor, wherein the first heating element and the second heating element are independent heating elements.

2. The domestic steam iron of claim 1, wherein said opening in said front portion of said steam generator comprises a substantially vertical conduit.

3. The domestic steam iron of claim 2, wherein the conduit comprises a tube.

4. The domestic steam iron of claim 2, further comprising an expansion chamber formed in the soleplate and a sheet which seals the expansion chamber from below and that covers the lower surface of the soleplate, the vertical conduit having a lower end which extends into the expansion chamber and further comprises lateral openings that allow steam generated in the vaporization chamber to pass from the vertical conduit to the expansion chamber and through said steam outlet holes.

5. The domestic steam iron of claim 1, wherein the proportion between the width of the vaporization chamber and the width of the soleplate is approximately three-quarters, and wherein the vaporization chamber and the soleplate have sides with the sides of the vaporization chamber being substantially parallel to those of the soleplate.

6. The domestic steam iron of claim 1, wherein said vaporization chamber further comprises two opposing side walls and at least one partition wall, wherein said at least one partition wall extends from a first of the two opposing side walls towards the other opposing side wall without attaching to said other opposing side wall and extends in height to substantially the full height of the vaporization chamber.

7. A domestic steam iron, comprising:

a soleplate having a plurality of steam outlet holes;

a steam generator having a front portion and a rear portion, the steam generator comprising:

a vaporization chamber for generating steam, the vaporization chamber comprising a front portion and a rear portion, wherein the rear portion of the vaporization chamber comprises an outlet;

an opening in the front portion of the steam generator, through which steam generated in the vaporization chamber passes to the steam outlet holes in the soleplate; and a pair of channels that extend substantially parallel to the soleplate, with one on either side of the vaporization chamber, from the outlet of the vaporization chamber to the opening in the front portion of the steam generator and that provide a passageway for steam generated in the vaporization chamber;

a first heating element, for heating the soleplate, the first heating element comprising a first thermal sensor; and a second heating element, for heating the steam generator, the second heating element comprising a second thermal sensor;

wherein the first heating element and the second heating element are independent heating elements, and wherein at least one of the first thermal sensor and the second thermal sensor is a NTC thermistor.

8. The domestic steam iron of claim 7, wherein said soleplate has a front section and a rear section, and wherein said steam outlet holes are concentrated in said front section of said soleplate and open into grooves that extend towards said rear section of said soleplate.

9. The domestic steam iron of claim 7, wherein the vaporization chamber further comprises two opposing side walls, said vaporization chamber further comprising at least one partition wall that extends from a first of the two opposing side portions towards the other opposing side portion without attaching to said other opposing side portion and that extends in height substantially the full height of the vaporization chamber, wherein the rear portion of the vaporization chamber comprises an outlet.

10. The domestic steam iron of claim 7, wherein the proportion between the width of the vaporization chamber and the width of the soleplate is approximately three-quarters, and wherein the vaporization chamber and the soleplate have sides and the sides of the vaporization chamber are substantially parallel to those of the soleplate.

11. The domestic steam iron of claim 7, wherein the front opening of the steam generator comprises a substantially vertical conduit forming a passageway to the steam outlet holes in the soleplate.

12. A domestic steam iron, comprising:

a soleplate having side walls, a front portion and a plurality of steam outlet holes extending through the soleplate, the steam outlet holes being congregated in the front portion of the soleplate;

a steam generator having a front portion and a rear portion, the steam generator comprising:

a single vaporization chamber for generating steam, the vaporization chamber comprising a front portion and a rear portion, opposing side walls and an outlet in the rear portion of the vaporization chamber, the proportion between the width of the vaporization chamber and the width of the soleplate being approximately three-quarters, and the side walls of the vaporization chamber being substantially parallel to the side walls of the soleplate;

an opening adjacent the front portion of the vaporization chamber, comprising a conduit, through which steam generated in the vaporization chamber passes to the steam outlet holes in the soleplate; and a pair of channels that extend, with one on each side of the vaporization chamber, from the outlet in the rear portion of the vaporization chamber to the opening in the front portion of the steam generator and that provide a passageway for the steam generated in the vaporization chamber;

a first heating element, for heating the soleplate, the first heating element comprising a first thermal sensor; and a second heating element, for heating the steam generator, the second heating element comprising a second thermal sensor, wherein the first heating element and the second heating element are independent heating elements.

13. The domestic steam iron of claim 12, wherein the vaporization chamber comprises at least two partition walls, a first partition wall being attached to a first opposing side wall and a second partition wall being attached to said other opposing side wall, wherein said first and second opposing side walls are different opposing side walls from one another.

14. The domestic steam iron of claim 12, wherein the opening comprises a vertical conduit providing a passageway from the channels to the steam outlet holes in the soleplate.

15. The domestic steam iron of claim 14, further comprising an expansion chamber formed in the soleplate, the expansion chamber being sealed below by a sheet that covers the lower surface of the soleplate, the vertical conduit further comprising lateral openings that allow steam generated in the vaporization chamber to pass from the vertical conduit to the expansion chamber and through said steam outlet holes.

16. A domestic steam iron comprising:

a soleplate having steam outlet holes for emitting steam and a first heating element; and a steam generator having a front end and a rear end, said steam generator comprising:

a vaporization chamber for generating steam and having a second heating element, wherein the proportion between the width of the vaporization chamber and the width of the soleplate is approximately three-quarters, and wherein the geometry of the vaporization chamber is such that its sides are parallel to those of the soleplate; and an opening in the front end of the steam generator comprising a vertical conduit, one end of which opens into an expansion chamber formed in the soleplate, the expansion chamber being sealed below by a sheet that covers the lower surface of the soleplate.

17. The domestic iron of claim 16, further comprising:

a first heating element, for heating the soleplate, the first heating element comprising a first thermal sensor; and a second heating element, for heating the steam generator, the second heating element comprising a second thermal sensor;

wherein the first heating element and the second heating element are different heating elements, and wherein at least one of the first thermal sensor and the second thermal sensor is an NTC thermistor.

18. The domestic iron of claim 16, wherein the vaporization chamber comprises a front portion, a rear wall, and two opposing side walls, the vaporization chamber further comprising at least one partition wall that extends from a first of the two opposing side portions towards the other opposing side portion without attaching to said other opposing side portion and that extends in height substantially the full height of the vaporization chamber, wherein the rear portion of the vaporization chamber comprises an outlet.

19. The domestic iron of claim 16, wherein said steam outlet holes in said soleplate are formed in an arrowhead formation and are concentrated in a front section of the soleplate, and wherein said steam outlet holes open into grooves that extend towards a rear section of the soleplate.

20. A domestic iron, comprising:

a soleplate having a lower surface with steam outlet holes therethrough and an expansion chamber, the expansion chamber being sealed below by a sheet that covers said lower surface of said soleplate;

a steam generator comprising:

a vaporization chamber having a front portion and a rear portion, said rear portion comprising an outlet; and a front opening, comprising a vertical conduit having a first end and a second end, wherein said first end is sealed and extends into said expansion chamber in said soleplate, the vertical conduit further comprising lateral openings that allow steam generated in the vaporization chamber to pass from the vertical conduit to the expansion chamber and through said steam outlet holes.

21. The domestic iron of claim 20, wherein the sheet that covers the lower surface of the soleplate is made of stainless steel.

22. The domestic iron of claim 20, wherein the vaporization chamber comprises a front portion and a rear portion, and wherein the rear portion of the vaporization chamber comprises an outlet that is covered by mesh.

23. The domestic steam iron of claim 20, wherein said steam outlet holes in said soleplate are formed in an arrowhead formation and are concentrated in a front section of the soleplate, and wherein said steam outlet holes open into grooves that extend towards a rear section of the soleplate.

24. The domestic steam iron of claim 20, wherein the vaporization chamber comprises a front portion, a rear portion, and two opposing side portions, the vaporization chamber further comprising at least one partition wall that extends from a first of the two opposing side portions towards the other opposing side portion without attaching to said other opposing side portion and that extends in height substantially the full height of the vaporization chamber.

* * * * *

UNITED STATES PATENT AND TRADEMARK OFFICE

CERTIFICATE OF CORRECTION

PATENT NO. : 7,096,612 B2
APPLICATION NO. : 11/046583
DATED : August 29, 2006
INVENTOR(S) : Javier A. Lesaga It is certified that error appears in the above-identified patent and that said Letters Patent is hereby corrected as shown below:

On the Title Page, Item (73) ("Assignee"), Line 2, after "S.A.," delete "Victoria-Alava" and insert -- Vitoria-Alava --, therefor.

In Column 1, Lines 7-23, delete "The present invention. . . and the vaporiser." and insert -- This invention relates to the plate of a domestic steam iron of standard construction that comprises an ironing element or plate which is in contact with the garment that is to be ironed, a vaporiser or steam generating appliance provided with water from a reservoir incorporated into the iron and that comprises a vaporisation chamber where the steam is produced which passes onto the plate by way of a front opening to emerge through a number of holes situated in the plate, and that also contains heat element components that are situated both on the plate and the vaporiser, each conserving the temperature of the plate and the vaporiser thermostatically, and each having thermal fuses for the plate and the vaporiser associated with the plate and the vaporiser. --, therefor.

In Column 1, Line 24, delete "subsidiary patent" and insert -- invention --, therefor.

Signed and Sealed this

Twenty-seventh Day of May, 2008

JON W. DUDAS
*Director of the United States Patent and Trademark Office*